United States Patent [19]

Rohner, deceased et al.

[11] Patent Number: 4,846,414

[45] Date of Patent: Jul. 11, 1989

[54] METHOD AND APPARATUS FOR AUTOMATIC ORDERLY REMOVAL AND COLLECTION OF FULLY-SPUN COPS FROM TEXTILE RING SPINNING MACHINES

[75] Inventors: Joachim Rohner, deceased, late of Monchen-Gladbach, by Jutta Rohner, heir; Manfred Langen, Monchen-Gladbach; Gregor Gebald, Korschenbroich-Pesch, all of Fed. Rep. of Germany

[73] Assignee: Zinser Textilmaschinen GmbH, Fed. Rep. of Germany

[21] Appl. No.: 114,670

[22] Filed: Oct. 28, 1987

[30] Foreign Application Priority Data

Oct. 28, 1986 [DE] Fed. Rep. of Germany ..... 3636705

[51] Int. Cl.[4] ..... B65H 67/06; D01H 9/18; D01H 9/00

[52] U.S. Cl. ..... 242/35.5 A; 57/268; 57/270

[58] Field of Search ..... 57/266, 267, 268, 270, 57/281; 242/35.5 A, 35.5 R, 35.6 R

[56] References Cited

U.S. PATENT DOCUMENTS

| | | | |
|---|---|---|---|
| 3,906,712 | 9/1975 | Miyazaki et al. | 242/35.5 A X |
| 4,088,226 | 5/1978 | Vlcek et al. . | |
| 4,144,961 | 3/1979 | Kasahara et al. | 242/35.5 A X |
| 4,181,228 | 1/1980 | Hashimoto et al. | 242/35.5 A X |
| 4,518,136 | 5/1985 | Rohner | 242/35.5 A |
| 4,597,540 | 7/1986 | Kiriake | 242/35.5 A X |
| 4,736,581 | 4/1988 | Uchida | 242/35.5 A X |

FOREIGN PATENT DOCUMENTS

| | | |
|---|---|---|
| 0047340 | 12/1980 | European Pat. Off. . |
| 2050928 | 4/1971 | Fed. Rep. of Germany . |
| 2028720 | 12/1971 | Fed. Rep. of Germany . |
| 2252928 | 3/1974 | Fed. Rep. of Germany . |
| 2521370 | 11/1976 | Fed. Rep. of Germany . |
| 2637998 | 3/1977 | Fed. Rep. of Germany . |
| 2856026 | 7/1980 | Fed. Rep. of Germany . |
| 2138926 | 7/1981 | Fed. Rep. of Germany . |
| 83216391 | 7/1983 | Fed. Rep. of Germany . |
| 8228716 | 3/1984 | Fed. Rep. of Germany . |
| 3303733 | 8/1984 | Fed. Rep. of Germany . |
| 119233 | 1/1960 | Japan . |
| 411653 | 11/1966 | Switzerland . |

*Primary Examiner*—Donald Watkins
*Attorney, Agent, or Firm*—Shefte, Pinckney & Sawyer

[57] ABSTRACT

A method and apparatus for automatically removing and collecting in an orderly manner fully-spun cops from a plurality of textile ring spinning machines of the type having longitudinal conveyors for transporting doffed cops to one machine end for collection. The present invention provides a respective transport apparatus in end-facing relation to each spinning machine for automatically bringing magazines to the machine for filling with doffed cops. A cart travels transversely intermediate the machines and their associated magazine transport apparatus to receive doffed cops from the machine conveyors and transfer them automatically into magazines provided on the associated magazine transport apparatus.

10 Claims, 1 Drawing Sheet

METHOD AND APPARATUS FOR AUTOMATIC ORDERLY REMOVAL AND COLLECTION OF FULLY-SPUN COPS FROM TEXTILE RING SPINNING MACHINES

BACKGROUND OF THE INVENTION

The present invention relates to a method and apparatus for automatically removing and collecting in an orderly manner fully-spun cops from a plurality of textile ring spinning machines and, more particularly, to such a method and apparatus adapted for ring spinning machines of the type wherein cops are doffed simultaneously fromm all spinning stations of a machine and conveyed by a transport arrangement longitudinally along the ring spinning machine to one longitudinal end thereof for collection.

In such ring spinning machines, a plurality of spinning stations are located along the length of the machine at each opposite longitudinal side thereof, with a transport arrangement preferably in the form of a moving belt-type conveyor extending along the length of each side of the machine to the aforesaid longitudinal end thereof. As disclosed in West German Patentschrift DE No. 21 38 926, it is known to provide a stationary device at the longitudinal end of such a ring spinning machine in association with each of the two conveyors thereof for grasping and removing the doffed cops in groups as they are delivered to the machine end by the conveyor and then transferring the grasped cops to a movable storage device. In a known variation of this arrangement, the groups of cops removed from the conveyors are inserted onto storage plates having cop supporting pins which plates are moved manually by means of a cart under the stationary cop removal device. Such cop removal devices are considerably expensive and therefore cannot be justified in many instances since the stationary devices are utilized for only short intermittent periods when a doffing operation occurs at the associated ring spinning machine and otherwise remain inactive for relatively long periods between doffings.

It is also known to utilize a movable cart to travel transversely with respect to the ends of a plurality of ring spinning machines to selectively deliver an automatic cop exchanging device to any individual ring spinning machine for traveling movement therealong to progressively perform at each spinning station a doffing and donning operation, i.e. removal of a fully-spun cop at each spinning station and replacement thereof with an empty spinning tube. This type of device is representatively disclosed in Japanese Patent Publication No. 60-119233. This device is also relatively expensive, while additionally suffering the disadvantage of requiring a considerable amount of time to accomplish a complete doffing and donning operation on a ring spinning machine.

SUMMARY OF THE INVENTION

It is therefore an object of the present invention to provide a novel method and apparatus by which fully-spun cops may be removed from a plurality of ring spinning machines and collected in an orderly fashion.

As aforementioned, the type of ring spinning machine to which the present invention relates basically includes a transport means for conveying fully-spun cops after doffing longitudinally along the ring spinning machine to one longitudinal end thereof for collection. In accordance with the present method and apparatus, a movable cart is provided for automatic traveling movement to the transport means at the one longitudinal end of each ring spinning machine following a doffing operation thereon. The cart includes suitable means for automatically receiving the doffed cops from the transport means of the ring spinning machine and delivering the received cops to a cop depositing location on the cart. The cart is further provided with means at the cop depositing location for automatically depositing the cops thereat in an orderly arrangement in a container adapted for storage of a plurality of fully-spun cops.

In the preferred embodiment, a plurality of container loading stations are provided, each being associated with a respective one of the ring spinning machines for disposition of the cart simultaneously at the transport means of a ring spinning machine and at the associated container loading station. Each container loading station includes suitable means for delivering and removing containers to and from the cart. The cart is arranged for movement along a pathway extending transversely between corresponding ends of the plurality of ring spinning machines, with the transport means of the ring spinning machines and the associated container loading stations positioned along the opposite sides of the pathway.

Preferably, each ring spinning machine is of the type having a transport means extending along each opposite longitudinal side of the machine. The cop receiving and delivering means of the cart includes a movable endless conveyor for orientation transversely with respect to the ring spinning machines for receiving doffed cops simultaneously from each transport means thereof.

The cop receiving and delivering means of the cart preferably includes means for preparing the cops for subsequent automatic processing. Further, the cop receiving and delivering means includes a transport device such as a conveyor mounted on the cart for selective extension therefrom. In addition, the cart has appropriate means for positioning the container in proper cop receiving relation with respect to the cop depositing means.

BRIEF DESCRIPTION OF THE PREFERRED EMBODIMENT

Figure 1:
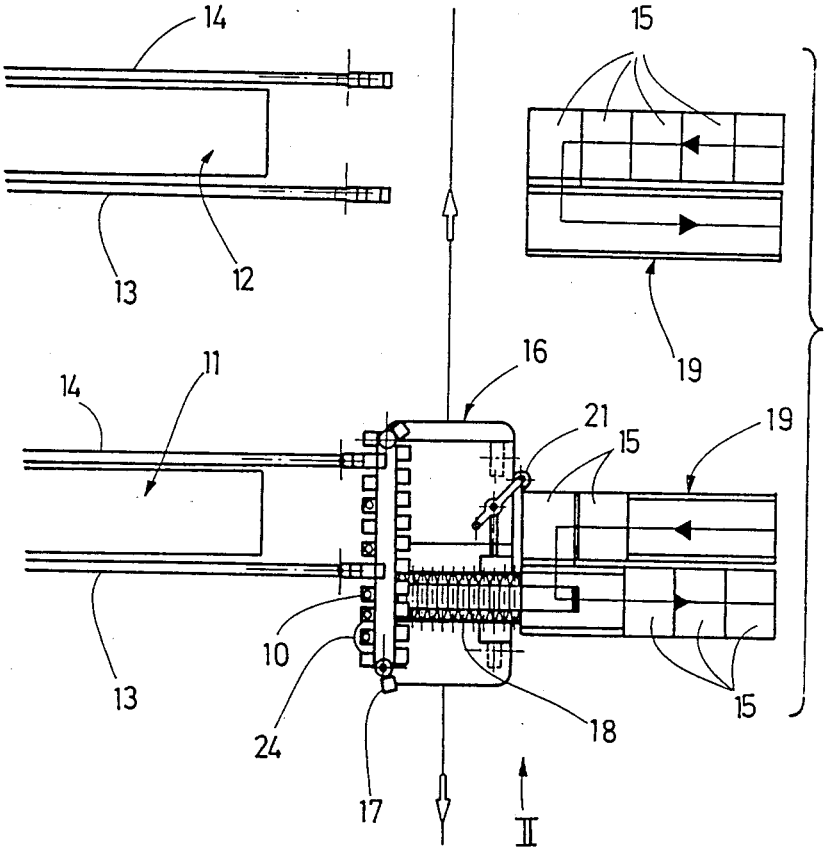
FIG. 1 is a schematic top plan view of the present cop removal and collecting apparatus arranged in association with ring spinning machines for carrying out the method of the present invention.
Figure 2:
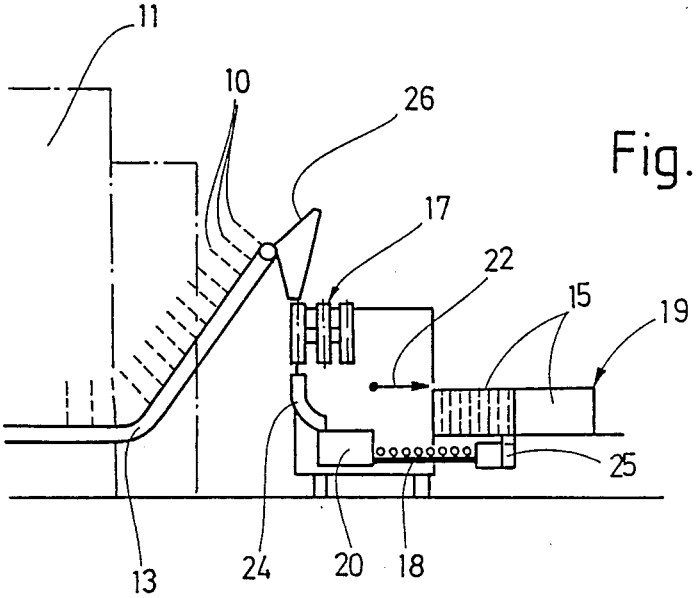
FIG. 2 is an elevational view of the cop removal and collecting apparatus and ring spinning machines of FIG. 1 as seen in the direction of arrow II therein.

Referring now to the accompanying drawings and initially to FIG. 1, a pair of typical textile ring spinning machines 11,12 are schematically illustrated in side-by-side parallel facing relationship as a plurality of ring spinning machines may typically be arranged. Each ring spinning machine 11,12 has a plurality of spinning stations arranged in alignment along the opposite longitudinal sides of the machine, each spinning station having a ring spindle for supporting a yarn tube for winding of yarn thereabout to produce a fully-spun yarn cop. Each of the ring spinning machines 11,12 is of a conventional construction of the type having a pair of transport arrangements 13,14, preferably in the form of a conveyor belt, respectively extending longitudinally along the opposite lengthwise sides of the machine adjacent its plural spinning stations for the full length of the machine. In conventional manner, the plural yarn cops at the spinning stations of any given lengthwise side of the ring spinning machines 11,12 are simultaneously doffed when fully spun and replaced by empty yarn tubes. The transport conveyor belts 13,14 are utilized for delivering the empty tubes to the individual spinning stations as well as for transporting the doffed fully-spun cops to one longitudinal end of the associated ring spinning machine 11,12. As seen in FIG. 2, the conveyor belts 13,14 are inclined upwardly at such end of the spinning machine to a discharge point at the terminal end of the conveyor 13,14 for discharging the fully-spun cops, representatively indicated at 10, for collection.

According to the present invention, an individual transport apparatus 19 is arranged in generally end-facing alignment with the discharge end of each ring spinning machine 11,12 for transporting suitable cop containers or magazines 15 to and from the machine-facing end of the apparatus 19 to receive the fully-spun cops 10 from the associated ring spinning machine. Each magazine 15 is compartmented or otherwise suitably adapted for orderly arrangement therein of a plurality of the fully-spun cops 10. As depicted in FIG. 1, each magazine transport apparatus 19 is constructed to provide a lengthwise magazine delivery path extending to the machine-facing end of the transport apparatus 19 and a parallel magazine removal path extending away therefrom, with a transverse reversal path extending between the delivery and removal paths at the machine-facing end of the apparatus 19. Preferably, each magazine transport apparatus 19 includes a pair of inclined roller conveyors forming the delivery and removal paths.

The present invention provides a movable cart 16 arranged to travel automatically along a pathway extending transversely intermediate the ring spinning machines 11,12 and their magazine transport apparatus 19 to establish a connection between each ring spinning machine 11,12 and its respective magazine transport apparatus 19 for transferring the doffed cops 10 from the machine conveyors 13,14 to the magazines 15 on the associated transport apparatus 19. For this purpose, the cart 16 is provided with rollable support wheels, at least one of which is driven, supported on suitable floor-mounted guide rails (not shown) extending along the cart pathway. As seen in FIG. 1, the ring spinning machines 11,12 their associated transport apparatus 19, and the cart 16 are cooperatively arranged so that when the cart 16 is positioned in cop-receiving relationship to a ring spinning machine, the cart 16 is simultaneously positioned properly at the associated magazine transport apparatus 19.

Each transport conveyor 13,14 of each ring spinning machine 11,12 is provided with a drop chute 26 at the upward discharge end of the conveyor, each drop chute 26 being adapted to gravitationally receive the full cops 10 from the associated conveyor 13,14 and to discharge the cops 10 one-by-one from the downward end of the drop chute 26 in a uniform orientation. The cart 16 includes a driven endless conveyor 17 having a plurality of tube-like pockets positioned at spacings along the length of the conveyor 17, each pocket being configured to receive one fully-spun cop 10. The conveyor 17 is disposed to move counterclockwise (as viewed in FIG. 1) in a horizontal plane with one run of the conveyor 17 extending transversely with respect to the longitudinal extent of the ring spinning machines 11,12 as well as transversely with respect to the transport conveyors 13,14 thereof so as to simultaneously pass immediately beneath the discharge underside of the drop chutes 26 of both transport conveyors 13,14 of a ring spinning machine when the cart 16 is positioned thereat. The cart 16 also includes a curved discharge tube 24 generally vertically oriented at a predetermined location beneath the conveyor 17, the discharge tube 24 being adapted to open each individual pocket of the conveyor 17 as it passes in order to gravitationally receive the cop 10 supported within the conveyor tube.

A device representatively indicated at 20 is provided on the cart for receiving the fully-spun cops 10 one-by-one as they are discharged gravitationally from the tube 24, the device preferably being arranged to prepare each cop 10 for subsequent automatic processing, such as at a winding machine, by locating the leading yarn end on each cop and inserting such end into the yarn tube of the cop. For this purpose, the device 20 may advantageously be of the construction and manner of operation disclosed in Swiss Patentschrift No. 411,653. A transport device 18, preferably in the form of an endless conveyor belt, is provided on the cart 16 at a discharge side of the cop-preparation device 20 for transporting away the cops 10 as they are discharged from the device 20 in spaced parallel relation extending transversely with respect to the lengthwise traveling extent of the transport device 18, as depicted in FIGS. 1 and 2. Preferably, the transport device 18 is selectively movable as desired to extend outwardly from the cart 16 toward the magazine transport apparatus 19. At the opposite end of the transport device 18, the cart includes a cop loading device 25 of a conventional construction and operation adapted for depositing cops 10 into a compatible magazine 15 from the underside of the magazine. For this purpose, the cop loading device 25 may advantageously be of the construction and operation disclosed in West German Offenlegungsschrift No. 20 28 720.

The cart 16 is provides with a positioning device 21 adapted to engage magazines 15 as they reach the end of the their delivery pathway on the apparatus 19 and to move each magazine tranversely along its reversal pathway to position each magazine 15 one-by-one in proper alignment directly above the cop loading device 25. Another positioning device, representatively indicated at 22 in FIG. 2, is also provided on the cart 16 for grasping each magazine 15 when properly positioned in cop receiving orientation above the transfer device 25. The positioning device 22 is operative to incrementally advance a grasped magazine 15 with respect to the cop loading device 25 to sequentially bring the individual cop compartments of the magazine 15 into proper register with the loading device 25. At the same time, the positioning device 22 moves each previously-filled magazine 15 along the removal pathway of the transport apparatus 19.

Each ring spinning machine 11 is provided with a signaling device (not shown) for communicating a signal to the cart 16 upon each doffing operation on the ring spinning machine. The cart 16 is provided with a compatible control arrangement (also not shown) for initiating driven traveling movement of the cart 16 to each ring spinning machine 11 when a doffing operation thereat is signaled. The cart 16 is adapted to dock at the signaling ring spinning machine in proper position for receiving doffed cops 10 from one or both of the transport conveyors 13,14 thereof. When so positioned, a control connection is established between the cart 16 and the signaling ring spinning machine by which the transport operation of the transport conveyors 13,14 is controlled.

Thus, the method of operation of the present apparatus will be understood. Upon proper docking of the cart 16 in control connection with a ring spinning machine signaling the occurrence of a doffing operation, as represented by machine 11 in FIG. 1, the operation of the transport conveyors 13,14 of the machine is initiated. At the same time, the endless conveyor 17 of the cart 16 advances along its transverse run incrementally one pocket at a time to insure that one of the conveyor pockets is always positioned beneath each drop chute 26 of the transport conveyors 13,14. The spacing interval of the pockets of the conveyor 17 are selected compatibly with the spacing between the transport conveyors 13,14 of the ring spinning machines and, through the control connection, the transport conveyors 13,14 are operated to alternatively fill the conveyor pockets. Thus, as the conveyor 17 circulates in its counterclockwise direction of movement, alternate pockets are filled at the discharge location of the conveyor 14 and intermediate pockets are filled at the discharge location of the conveyor 13 to insure that all pockets of the conveyor 17 are filled after passing the transport conveyor 13. Subsequently, the discharge tube 24 engages the underside of each pocket of the conveyor 17 to open the pocket for gravitational discharge of the cop 10 contained therein. The discharge tube 24 delivers each cop 10 into the preparation device 20 from which the cops are discharged onto the transport device 18 for delivery to the cop loading device 25 which deposits the cops 10 into a magazine 15 positioned on the transport apparatus 19 by the positioning devices 21,22.

As will thus be understood, the method and apparatus of the present invention enable the automation of the removal and collection of doffed cops from textile ring spinning machines which is both time and cost effective. Particularly, since the cart of the present invention is designed for use with a plurality of ring spinning machines, a relatively high cost of the cart may be well justified when considered on a per machine basis. Further, since the cart incorporates the cop preparation device 20, the present invention integrates this cop preparation step which must be performed in any event when further automatic processing of the doffed cops is contemplated. Location of the preparation device within the cart is also of significant cost benefit since a single preparation device may then be utilized to service a plurality of ring spinning machines.

It is also contemplated that the cart 16 may be utilized for automatic cop removal and collection from ring spinning machines which are set up on respective sides of the machine or in respective spinning station sections thereof to spin yarns of different yarn characteristics, e.g. yarns of the same count but of different colors or the like. In such instance, the cart 16 and the transport conveyors 13,14 are compatibly arranged for the collection of doffed cops 10 from only one transport conveyor 13,14 at a time. Thus, the pocket conveyor 17 of the cart 16 would be advanced incrementally for filling of each pocket in sequence with a cop 10 from the particular active transport conveyor 13 or 14. In this manner, cops spun with yarn of the same characteristics will be automatically sorted into separate magazines in the course of the operation of the present apparatus and method.

It will therefore be readily understood by those persons skilled in the art that the present invention is suceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method for automatically removing and collecting in an orderly manner fully-spun cops from a plurality of textile ring spinning machines, each ring spinning machine being the type wherein cops are conveyed after doffing by transport means longitudinally along the ring spinning machine to one longitudinal end thereof for collection, said method comprising the steps of providing a movable cart and containers adapted for orderly arrangement therein of a plurality of fully-spun cops, delivering and removing the containers to and from a plurality of container loading stations each of which is associated with a respective one of said ring spinning machines, automatically moving said cart to the transport means at the one longitudinal end of each ring spinning machine following a doffing operation thereon and simultaneously positioning said cart at the associated container loading station, receiving the doffed cops by said cart, automatically delivering the received cops to a cop depositing location on said cart, and automatically depositing the cops at said cop depositing location in orderly arrangement in a container at the associated container loading station.

2. A method according to claim 1 and characterized further by, after receiving said cops by said cart, automatically preparing said cops for subsequent automatic processing.

3. A method according to claim 1 and characterized further by moving said cart transversely between corresponding ends of said plurality of ring spinning machines for automatically removing and collecting fully-spun cops at each thereof.

4. Apparatus for automatically receiving and collecting in an orderly manner fully-spun cops from a plurality of textile ring spinning machines, each ring spinning machine being of the type having transport means for conveying cops after doffing longitudinally along the ring spinning machine to one longitudinal end thereof for collection, said apparatus comprising a cart automatically movable to the transport means at the one longitudinal end of each ring spinning machine for receiving doffed cops therefrom following a doffing operation thereon, containers adapted for oderly arrangement therein of a plurality of fully spun cops, and a plurality of container loading stations each of which is associated with a respective one of said ring spinning machines for disposition of said cart simultaneously at the transport means of a ring spinning machine and the associated container loading station, each said container loading station including means for delivering and removing containers to and from said cart, said cart including means for automatically depositing cops into a container at a container loading station and means for automatically receiving and delivering doffed cops from said transport means of said ring spinning machines to said cop depositing means.

5. Apparatus according to claim 4 and characterized further in that said cart is arranged for movement along a pathway having said transport means of said ring spinning machines and the associated container loading stations along the opposite sides of said pathway.

6. Apparatus according to claim 4 and characterized further in that each ring spinning machine includes transport means extending along each opposite longitudinal side of the machine, and said cop receiving and delivering means includes a movable endless conveyor for orientation transversely with respect to the ring spinning machines for receiving doffed cops simultaneously from each transport means thereof.

7. Apparatus according to claim 4 and characterized further in that said cop receiving and delivering means includes means for preparing said cops for subsequent automatic processing.

8. Apparatus according to claim 4 and characterized further in that said cop receiving and delivering means includes a transport device mounted on said cart for selective extension therefrom.

9. Apparatus according to claim 4 and characterized further in that said cart includes means for positioning said container in cop receiving relation with respect to said cop depositing means.

10. Apparatus for automatically receiving and collecting in an orderly manner fully-spun cops from a plurality of textile ring spinning machines, each ring spinning machine being of the type having transport means extending along each opposite longitudinal side of the machine for conveying cops after doffing longitudinally along the ring spinning machine to one longitudinal end thereof for collection, said apparatus comprising a cart automatically movable to the transport means at the one longitudinal end of each ring spinning machine for receiving doffed cops therefrom following a doffing operation thereon and a container adapted for orderly arrangement therein of a plurality of fully spun cops, said cart including means for automatically depositing cops into said container and means for automatically receiving and delivering doffed cops from said transport means of said ring spinning machines to said cop depositing means, said cop receiving and delivering means including a movable endless conveyor for orientation transversely with respect to the ring spinning machines for receiving doffed cops simultaneously from each transport means thereof.

* * * * *